US007247804B2

(12) United States Patent
Eriksson et al.

(10) Patent No.: US 7,247,804 B2
(45) Date of Patent: Jul. 24, 2007

(54) SWITCH FOR HIGH VOLTAGE AND/OR CURRENT

(75) Inventors: Bjørn Eriksson, Prestfoss (NO); Viggo Landaas, Kongsberg (NO)

(73) Assignees: EB Elektro AS, Hokksund (NO); Bennex Omnitec AS, Kongsberg (NO)

( * ) Notice: Subject to any disclaimer, the term of this patent is extended or adjusted under 35 U.S.C. 154(b) by 0 days.

(21) Appl. No.: 11/260,477

(22) Filed: Oct. 28, 2005

(65) Prior Publication Data

US 2006/0131143 A1 Jun. 22, 2006

(30) Foreign Application Priority Data

Nov. 4, 2004 (NO) ..... 20044811

(51) Int. Cl.
*H01H 31/00* (2006.01)

(52) U.S. Cl. ..... 200/48 R; 200/293

(58) Field of Classification Search ..... 200/48 R, 200/293, 252–261; 361/605
See application file for complete search history.

(56) References Cited

U.S. PATENT DOCUMENTS 3,555,279 A * 1/1971 Manz et al. ..... 218/92
4,250,476 A * 2/1981 Evans et al. ..... 335/17
5,134,989 A 8/1992 Akahane
6,326,567 B1 * 12/2001 Sciarra ..... 200/48 V
2002/0071242 A1 * 6/2002 Yamagiwa et al. ..... 361/605

FOREIGN PATENT DOCUMENTS

| | | |
|---|---|---|
| GB | 1169459 | 11/1969 |
| GB | 1223291 | 2/1971 |
| GB | 1316380 | 5/1973 |
| GB | 1404652 | 9/1975 |
| GB | 2147458 A | 5/1985 |
| GB | 2214004 A | 8/1989 |
| GB | 2402551 A | 12/2004 |
| NO | 36063 | 10/1922 |
| SE | 183 822 | 3/1963 |
| WO | 84/04201 A1 | 10/1984 |
| WO | 03/081728 A1 | 10/2003 |

* cited by examiner

*Primary Examiner*—Michael Friedhofer
*Assistant Examiner*—Lisa Klaus
(74) *Attorney, Agent, or Firm*—Rothwell, Figg, Ernst & Manbeck, PC

(57) ABSTRACT

Electrical switch designed for high voltage and/or current and surrounded by a housing (2) divided into a first part (2') forming a first compartment for taking up at least one switching device (3) and an appurtenant actuator device (4), and a second part (2") forming a second compartment for connecting of at least one phase. At least the first part (2') of the housing (2) is pressure sealed encapsulated and filled with oil under pressure.

14 Claims, 3 Drawing Sheets

SWITCH FOR HIGH VOLTAGE AND/OR CURRENT

TECHNICAL FIELD

The present invention relates to a switch or breaker adapted for high voltage and/or current, particularly in three-phase systems or lines.

In this connection with the term "switch" it is also meant switching or switch devices with switching function. It can also concern circuit breakers or switches, such as disconnecting switches/disconnectors, or the like.

TECHNICAL BACKGROUND

In connection with oil installations on the bottom of the sea, there has been, in the last years, a development where the oil companies demand disconnecting switches and circuit breakers for high voltage and/or current, which can be installed or operated under water.

It is known that a type of medium voltage disconnector or disconnecting switch has been developed and delivered for use under water. Yet this can break and close the electrical circuit in a power-off or voltageless mode.

There are not any pure high voltage circuit breakers for underwater use, from the surface and down to depths as for example 3000-4000 m, or even deeper.

SUMMARY OF THE INVENTION

The current invention provides an electrical switch intended for high voltage and/or high current. Additional features of the invention are described. Further details will become apparent from the following exemplifying description with reference to the accompanying drawings.

The advantages with the switch according to the invention are that the high oil pressure in the switching device will provide for improved switching properties such as for example electric arc extinguishing.

High pressure is obtained by pressure adjusting or balancing at deeper waters or pressure setting at shallow waters.

Under circuit switching or current interruption, a momentary increase or rise of pressure is obtained.

BRIEF DESCRIPTION OF THE DRAWINGS

In what follows, the invention shall be explained in details under reference to the drawings, where.

DETAILED DESCRIPTION OF THE INVENTION

Figure 1:
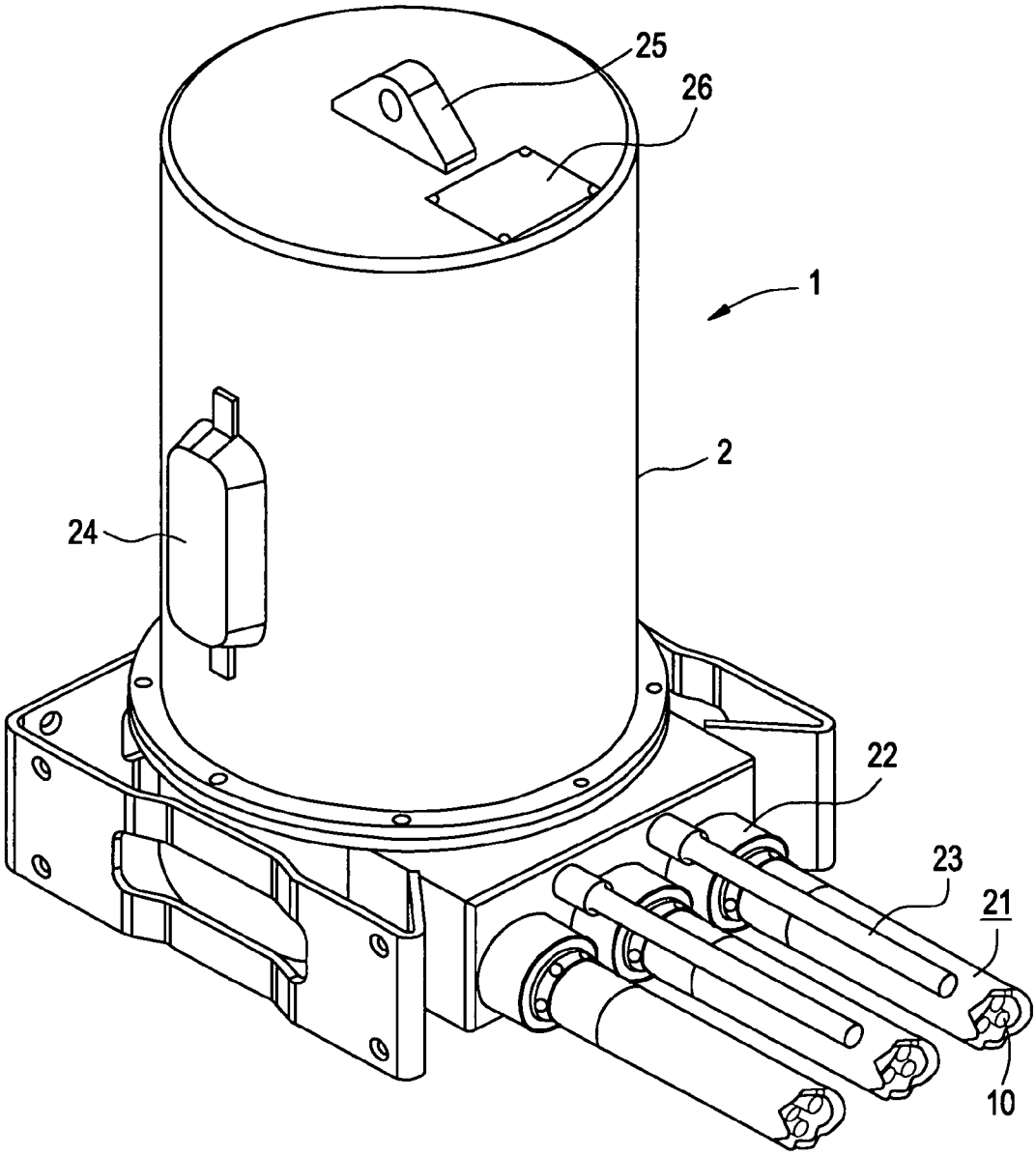
FIG. 1 shows in perspective an example of a three-phase switch according to the invention.

FIG. 1 shows in perspective an example of a three-phase switch 1 according to the invention. However, this switch 1 shall not be limited only to three-phase systems or lines. The electrical switch 1 is adapted for high voltage and/or current and comprises a housing 2. The housing 2 of the switch 1 is pressure sealed encapsulated and filled with a fluid, preferably oil, under high pressure, especially a pressure of preferably at least 2-3 bar. The switch 1 according to the invention can be used under water, especially in deep waters. When used in deep waters the pressure in the entire housing 2 will be approximately the same as the pressure in the surroundings. For example at 3000 m depth, the pressure in the housing 2 will be around 300 bar. When used in shallow waters the pressure in the housing 2 will be higher than the pressure in the surroundings, preferably at least 10 bar. The switch 1 according to the invention comprises at least one feed-through bushing 22 allowing connecting of at least one phase 10 to the switch 1. The phase 10 can be put in a pipe or tube 21. The switch 1 can additionally comprise at least one pipe 23 for communication with a driving mechanism 14, and there can be arranged a cathodic protection 24. On the top or upper part of the switch 1 a lifting eye 25 can also be arranged. If necessary, the switch 1 can be marked with a marking plate and/or an indicator 26 so that a ROV vessel ("remotely operated vehicle") could find the switch 1 when it is used under water. The switch 1 has also means for fastening to any installation.

The switch 1 according to the invention can also be used on land. In this case the pressure in that part or section 2' (FIG. 2) of the housing 2 where the switching occurs will preferably be at least 10 bar. At least part or section 2' of the housing 2 where the switching occurs shall be pressure sealed encapsulated and filled with oil under high pressure. When used on land the connecting part or section 2" (FIG. 2) of the housing 2 can be pressure sealed encapsulated and filled with oil under a pressure of preferably at least 2 bar. The switch 1 according to the invention can be used as a "switch" or switching device, where the switching process does not happen under power, e.g. for switching the electrical power between two power consumers, such as for example pump motors and/or pipe heating systems, or as a circuit breaker or power switch, where the switching process takes place in power-on mode. Other possible applications of the breaker or switch 1 according to the invention shall not be excluded.

Figure 2:
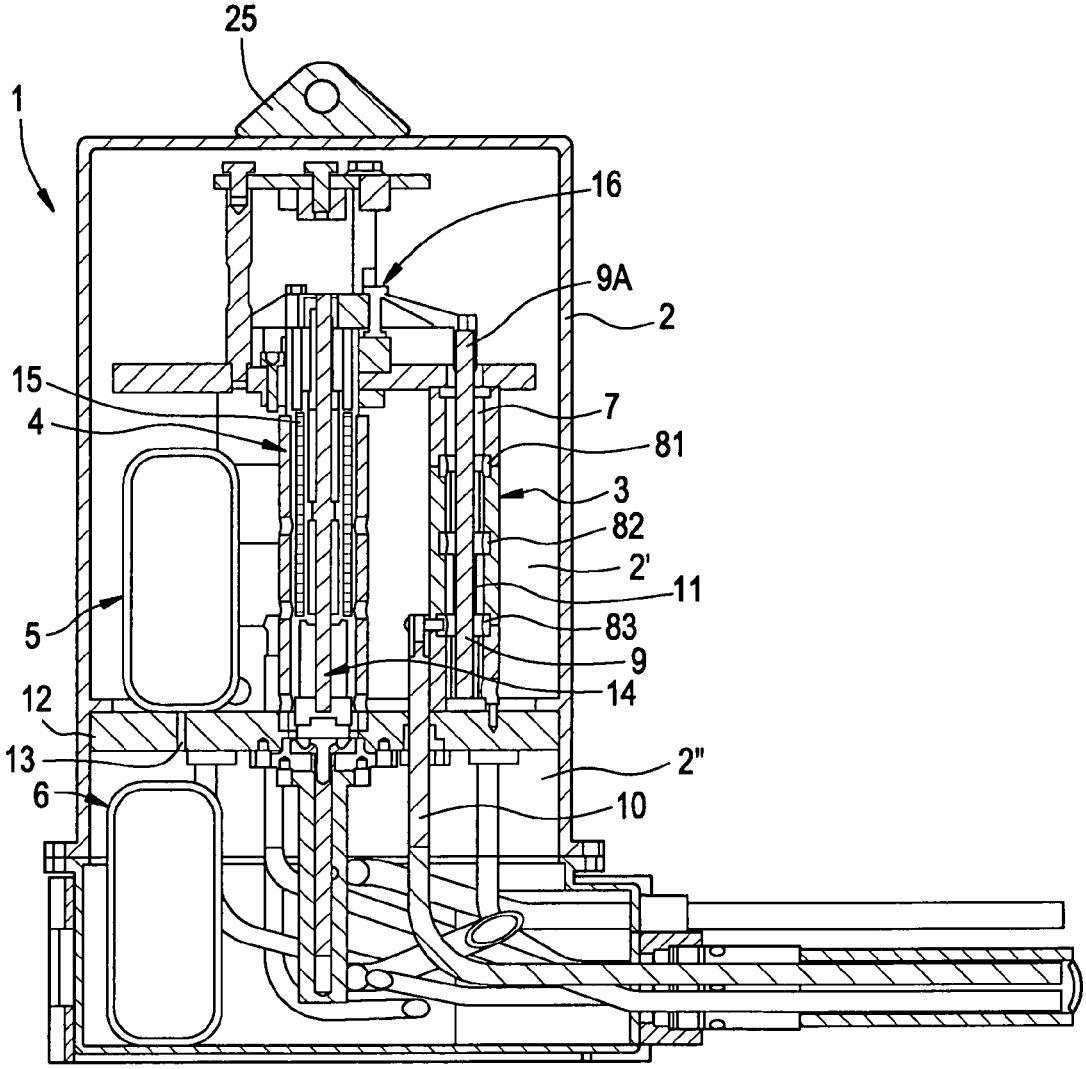
FIG. 2 shows a cut section of the three-phase switch in FIG. 1.

On FIG. 2 it is shown that the housing 2 can comprise a first part or section 2' forming a first compartment for taking up at least one switching device 3 and at least one actuator device 4, and a second part or section 2" forming a second compartment for connecting of at least one phase 10, wherein at least the first part 2' of the housing 2 is pressure sealed encapsulated and filled with a fluid, preferably oil, under a high pressure of preferably at least 10 bar. The second part 2" of the housing 2 can also be encapsulated and filled with a fluid, preferably oil, under a pressure of preferably at least 2-3 bar. The oil in the switching part or section 2' of the housing 2 can be for example a switching oil, and the oil in the connecting part or section 2" of the housing 2 can be for example a silicon oil. This is because the two parts or sections of the housing 2 have different functions, and the properties of the oil (as for example viscosity, electric arc extinguishing and insulating properties) in these two parts must be adapted for the respective functions. Further the first part 2' comprises at least one first compensator 5 which regulates the oil volume in the first part 2' of the housing 2, and the second part 2" can comprise at least one second compensator 6 regulating the oil volume in the second part 2" of the housing 2. The wall 12 separating the first 2' and the second 2" part of the housing 2 can comprise means, as for example a passage, 13 for fluid communication between the compensator in the first compartment and the second compartment in the housing 2. The wall in the second 2" part of the housing 2 can comprise second means, as for example a second passage, 33 for fluid communication between the compensator in the second compartment and the environments, that is the sea when used under water.

The switching device 3 that is shown comprises a contact chamber 7 with three stationary electrical conductive contact elements 81, 82, 83 for a phase 10 and a piston 9 in this contact chamber 7. The piston 9, which is made of insulating material, is in its one end 9A connected with the actuator device 4 and comprises a moveable electrical conductive contact element 11 for the phase 10, which in a first stable position of the piston 9 establishes contact between a first 81 and a middle 82 of the three contact elements 81, 82, 83, and which in a second stable position of the piston 9 makes contact between the middle 82 and a second 83 of the three contact elements 81, 82, 83.

The actuator device 4 further comprises a drive mechanism 14 in combination with a spring mechanism 15 for quick movement of the piston 9 in said at least one switching device 3 from the first stable position to the second stable position and vice versa. The spring mechanism 15, if necessary in combination with a holding and releasing device 16, can be adapted to ensure that there are only two stable positions of the piston 9, 9', namely a first and a second. When failure in the driving mechanism 14 occurs, the switch 1 will remain in one of its two stable positions and will never stop in a middle unstable position. The hold and release device 16 holds back the piston 9 and ensures that there is enough spring power accumulated within the device in order to make or execute the piston movement, and also releases the piston 9 and allows it make or execute its quick switching movement, driving the contact elements 11, 81, 82, 83 of the switch 1 from the first stable position to the second stable position and vice versa. The holding and releasing device 16 can be made by use of permanent magnets or electromagnets. The hold and release device 16 can also be made by using one in principle known mechanical hold and release device. The driving power of the drive mechanism 14 is produced by means of at least one of the following: hydraulic, electrical, pneumatic, mechanical, manual or other suitable driving power. The power in the spring mechanism 15 is achieved by means of any suitable accumulating power source, such as for example helical or coil spring or gas spring.

The three stationary, electrical conductive contact elements 81, 82, 83 can be ring-shaped and arranged on the inside of the contact chamber 7 which also can be ring-shaped, and the moveable, electrical conductive contact element 11 can be substantially sleeve-shaped and fastened around the piston 9 approximately in its middle area (FIG. 2).

In a first embodiment the switch 1 according to the invention comprises three switching devices 3 for use in three-phase systems or lines. In this case the three pistons 9 are connected with said at least one actuator device 4 in its one ends 9A.

Figure 3:
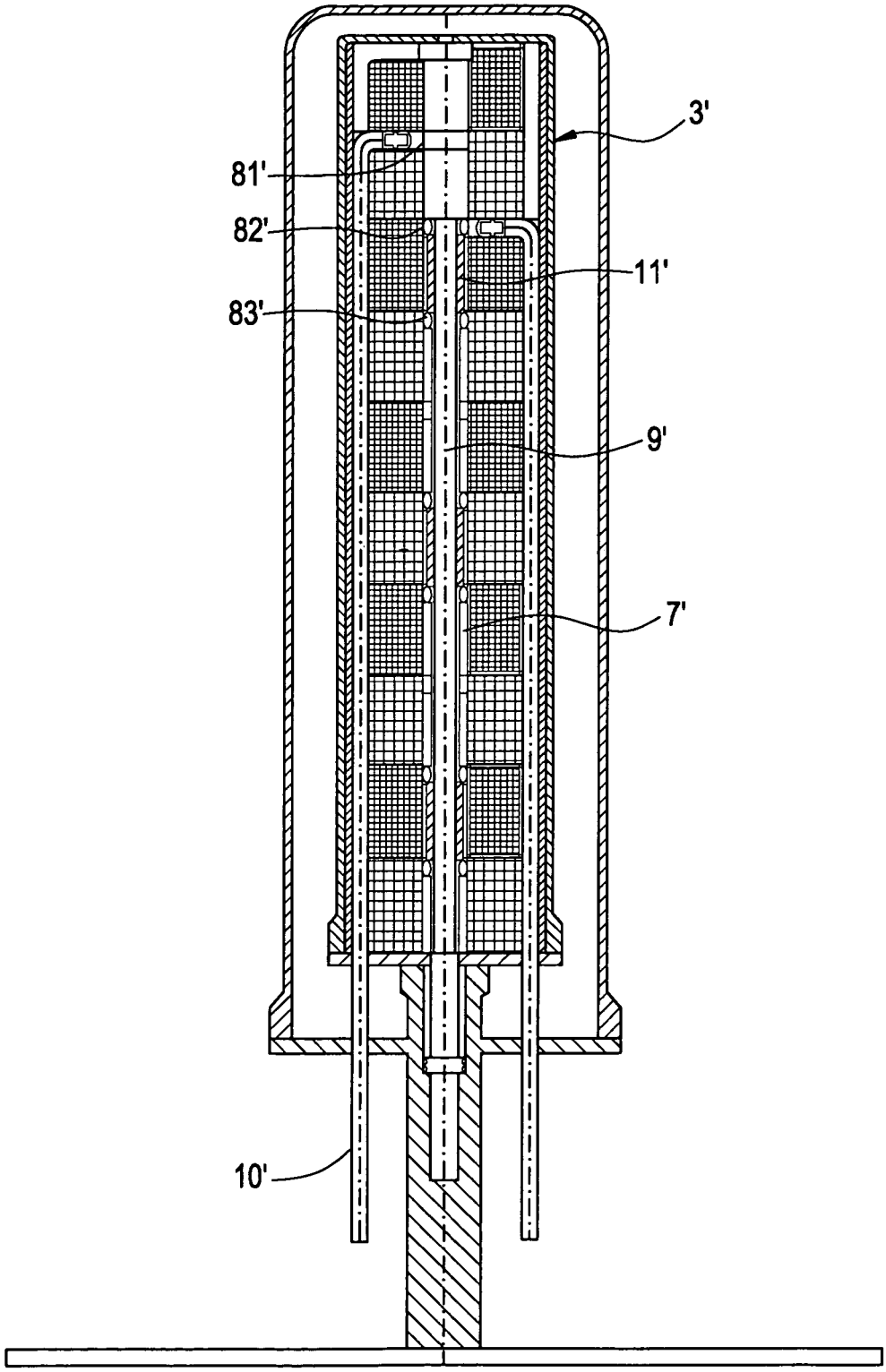
FIG. 3 shows another example of a three-phase switch according to the invention, where the three switching devices are connected in parallel in one common contact chamber.

In a second embodiment shown on FIG. 3 the switch 1 according to the invention can comprise three switching devices connected in parallel for use in three-phase systems or lines. In this case the three switching devices are arranged in such a way that they form a common switching mechanism 3' having one common contact chamber 7' with three stationary, electrical conductive contact elements 81', 82', 83' for each 10' of the three phases, and one common piston 9', within the common contact chamber 7', comprising a moveable, electrical conductive contact element 11' for each 10' of the three phases.

An additional advantage of the switch 1 according to the invention is that the two parts or sections of the housing 2, when used under water, provide for forming of a double barrier between the contact chamber and the sea water.

The invention claimed is:

1. Electrical switch comprising a housing (2) divided into a first section (2') forming a first compartment for taking up at least one switching device (3) and an associated actuator device (4), and a second section (2") forming a second compartment for connecting of at least one phase to the switching device (3), where at least the first section (2') of the housing (2) is pressure sealed and filled with oil under a pressure of at least 10 bar, where the first section (2') comprises at least one first compensator (5) for regulating the oil volume in the first section (2') of the housing (2), and where the second section (2") comprises at least one second compensator (6) for regulating the oil volume in the second section (2") of the housing (2).

2. Switch according to claim 1, where the second section (2") of the housing (2) is pressure sealed encapsulated and filled with oil under a pressure of at least 2 bar.

3. Switch according to claim 1, where the pressure in the first section (2') of the housing (2) is substantially the same as the pressure in the second section (2") of the housing (2).

4. Switch according to claim 1, where the pressure in the first section (2') of the housing (2) is bigger than the pressure in the second section (2") of the housing (2).

5. Switch according to claim 1, where said at least one switching device (3) comprises a contact chamber (7) with three stationary, electrical conductive contact elements (81, 82, 83) for said at least one phase (10), and a piston (9) in the contact chamber (7), the piston (9) being of an insulating material is in its one end (9A) connected with at least one actuator device (4) and comprises a moveable, electrical conductive contact element (11) for said at least one phase (10), which in a first stable position of the piston (9) establishes contact between a first (81) and a middle (82) of the three contact elements (81, 82, 83), and which in a second stable position of the piston (9) establishes contact between the middle (82) and a second (83) of the three contact elements (81, 82, 83).

6. Switch according to claim 5, where said at least one actuator device (4) comprises a driving mechanism (14) and a spring mechanism (15) for quick movement of the piston (9) in said at least one switching device (3) from the first stable position to the second stable position and vice versa, where driving power for the driving mechanism (14) is produced by means of at least one of the following: hydraulic, electrical, pneumatic, mechanical, manual or other suitable driving power, and where power in the spring mechanism (15) is achieved by means of any suitable accumulating power source.

7. Switch according to claim 5, where the three stationary, electrical conductive contact elements (81, 82, 83) are ring-shaped and are arranged on the inside of the contact chamber (7) which is also ring-shaped, and the moveable, electrical conductive contact element (11) is substantially sleeve-shaped and fastened around the piston (9) approximately in its middle area.

8. Switch according to claim 5, where a hold and release device (16) holds back the piston (9) and ensures that enough spring power is accumulated within the hold and release device in order to make the piston movement, and releases the piston (9) and allows it make its quick switching movement, driving the stationary, electrical conductive contact elements (11, 81, 82, 83) of the switching device from the first stable position to the second stable position and vice versa, the device (16) being made by use of permanent magnets or electromagnets or other mechanical hold and release mechanism.

9. Switch according to claim 5, comprising three switching devices (3) for use in three-phase systems, where one ends of the pistons (9) are jointly connected with said at least one actuator device (4).

10. Switch according to claim 1, where a wall (12) dividing the first (2') and second (2") section of the housing (2), comprises means (13) for fluid communication between said at least one first compensator (5) in the first compartment in the housing (2) and the at least one second compensator (6).

11. Switch according to claim 10, where the wall in the second (2")section of the housing (2) comprises second means (33) for fluid communication between the compensator in the second compartment and the surroundings.

12. Switch according to claim 1, comprising three switching devices for use in three-phase systems, where the three switching devices are connected in parallel and arranged in such a way that they form a common switching mechanism (3') having one common contact chamber (7') with three stationary, electrical conductive contact elements (81', 82', 83') for each (10') of the three phases, and one common piston (9') in the common contact chamber (7'), comprising a moveable, electrical conductive contact element (11') for each (10') of the three phases.

13. Switch according to claim 1, where the first section (2') of the housing (2) is filled with a switching oil, and the second section (2") of the housing (2) is filled with another type of oil.

14. A method of using the switch according to claim 1 underwater, where pressure in the housing (2) is at least the same as water pressure in the surroundings.

* * * * *